US011287763B2

(12) United States Patent
Kawamura et al.

(10) Patent No.: US 11,287,763 B2
(45) Date of Patent: Mar. 29, 2022

(54) TONER TRANSPORT APPARATUS

(71) Applicant: CANON KABUSHIKI KAISHA, Tokyo (JP)

(72) Inventors: Tomofumi Kawamura, Shizuoka (JP); Masato Tanabe, Shizuoka (JP); Takatoshi Hamada, Shizuoka (JP); Yusuke Atsu, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/092,663

(22) Filed: Nov. 9, 2020

(65) Prior Publication Data

US 2021/0149324 A1 May 20, 2021

(30) Foreign Application Priority Data

Nov. 15, 2019 (JP) ..... JP2019-207173

(51) Int. Cl.
*G03G 15/08* (2006.01)
*G03G 15/10* (2006.01)

(52) U.S. Cl.
CPC ..... *G03G 15/0877* (2013.01); *G03G 15/0865* (2013.01); *G03G 15/0891* (2013.01); *G03G 15/105* (2013.01)

(58) Field of Classification Search
CPC ..... G03G 15/105; G03G 15/0891
See application file for complete search history.

(56) References Cited

U.S. PATENT DOCUMENTS

| | | | | |
|---|---|---|---|---|
| 6,738,593 | B2 | 5/2004 | Kawamura et al. | |
| 6,917,779 | B2 * | 7/2005 | Fujimori | G03G 15/0848 399/258 |
| 8,761,642 | B2 | 6/2014 | Tajiri et al. | |
| 9,823,603 | B2 | 11/2017 | Murakami et al. | |
| 2009/0016777 | A1 * | 1/2009 | Miyamoto | G03G 15/0855 399/238 |
| 2012/0224889 | A1 | 9/2012 | Tajiri et al. | |

FOREIGN PATENT DOCUMENTS

| | | | |
|---|---|---|---|
| JP | H07-72673 | A | 3/1995 |
| JP | 2000-221764 | A | 8/2000 |
| JP | 2005-338326 | A | 12/2005 |
| JP | 5762052 | B2 | 8/2015 |

* cited by examiner

*Primary Examiner* — Victor Verbitsky
(74) *Attorney, Agent, or Firm* — Venable LLP

(57) ABSTRACT

A toner transport apparatus includes a toner, a transport container having a transport path for transporting the toner toward the developing apparatus, and a pipe through which the toner is transported from the toner container to the transport container, with the pipe having an outlet hole from which the toner is discharged into the transport container. An air pump transports the toner from the toner container to the transport container, and an optical sensor includes a light-emitting element to emit a light and a light-receiving element to receive the light so that an optical path from the light-emitting element to the light-receiving element intersects with a passage area of the toner through which the toner passes after being discharged from the outlet hole of the pipe and before landing at a landing point of the transport container.

13 Claims, 10 Drawing Sheets

TONER TRANSPORT APPARATUS

BACKGROUND OF THE INVENTION

Field of the Invention

The present invention relates to a toner transport apparatus.

Description of the Related Art

Image forming apparatuses which use an electrophotographic system to form images by forming toner images, such as printers, copiers, and facsimile machines, are equipped with developer supply apparatuses in developing apparatuses to supply developer which has been consumed by the formation of images. A developer supply apparatus stores, in a storage unit (a hopper), a certain amount of developer taken from a developer container, and operates a transport means to supply the developer to the developing apparatus from the storage unit at the required time.

Patent Literature 1 (Japanese Patent No. 5762052) proposes a configuration in which toner taken from a toner bottle, which is an example of a developer container, is held in a low-capacity hopper, and is transported to the developing apparatus at the required time using a screw-type transport mechanism. According to Patent Literature 1, it is necessary to continuously store and hold a constant amount of toner within a reservoir unit so that the screw-type transport mechanism can supply the toner in a stable manner. As such, a control unit in an image forming apparatus according to Patent Document 1 uses an optical sensor to detect the surface height of the toner within the storage unit, and on the basis of that information, controls the amount of toner resupplied to the storage unit from the toner bottle.

SUMMARY OF THE INVENTION

In Patent Document 1, toner is output to the storage unit from the toner bottle, which serves as a developer container, and the toner is then resupplied to the developing apparatus from the storage unit via a transport path. The remaining amount of toner is detected using an optical sensor which detects whether or not toner is present at a predetermined height within the storage unit. As such, the system will determine that there is toner left as long as toner remains in the storage unit, even if there is no more toner in the developer container. Thus even when the developer container is empty or near empty, it will take a certain amount of time for the system to determine that there is no toner remaining.

Having been achieved in light of the foregoing issue, an object of the present invention is to provide a technique for quickly determining that a developer container holding toner is empty or almost empty.

The present invention provides a toner transport apparatus comprising:

a storing portion configured to store toner used by a developing apparatus;

an ejection port for outputting the toner from the storing portion;

a transport path unit that includes a receiving part which receives the toner ejected from the ejection port, and configured to constitute a transport path for transporting the toner to the developing apparatus;

a pump for outputting the toner held in the storing portion from the ejection port toward the transport path unit; and an optical sensor unit that is disposed in a passage area through which the toner output by the pump from the ejection port to the transport path unit passes, the optical sensor unit detecting whether or not toner is present.

Further features of the present invention will become apparent from the following description of exemplary embodiments with reference to the attached drawings.

DESCRIPTION OF THE EMBODIMENTS

Hereinafter, an exemplary embodiment of the present invention will be described in detail with reference to the drawings. Note that the scope of the invention is not intended to be limited to the dimensions, materials, shapes, relative arrangements, and so on of the constituent elements described in this embodiment unless indicated otherwise.

First Embodiment

Overall Configuration of Apparatus

Figure 2:
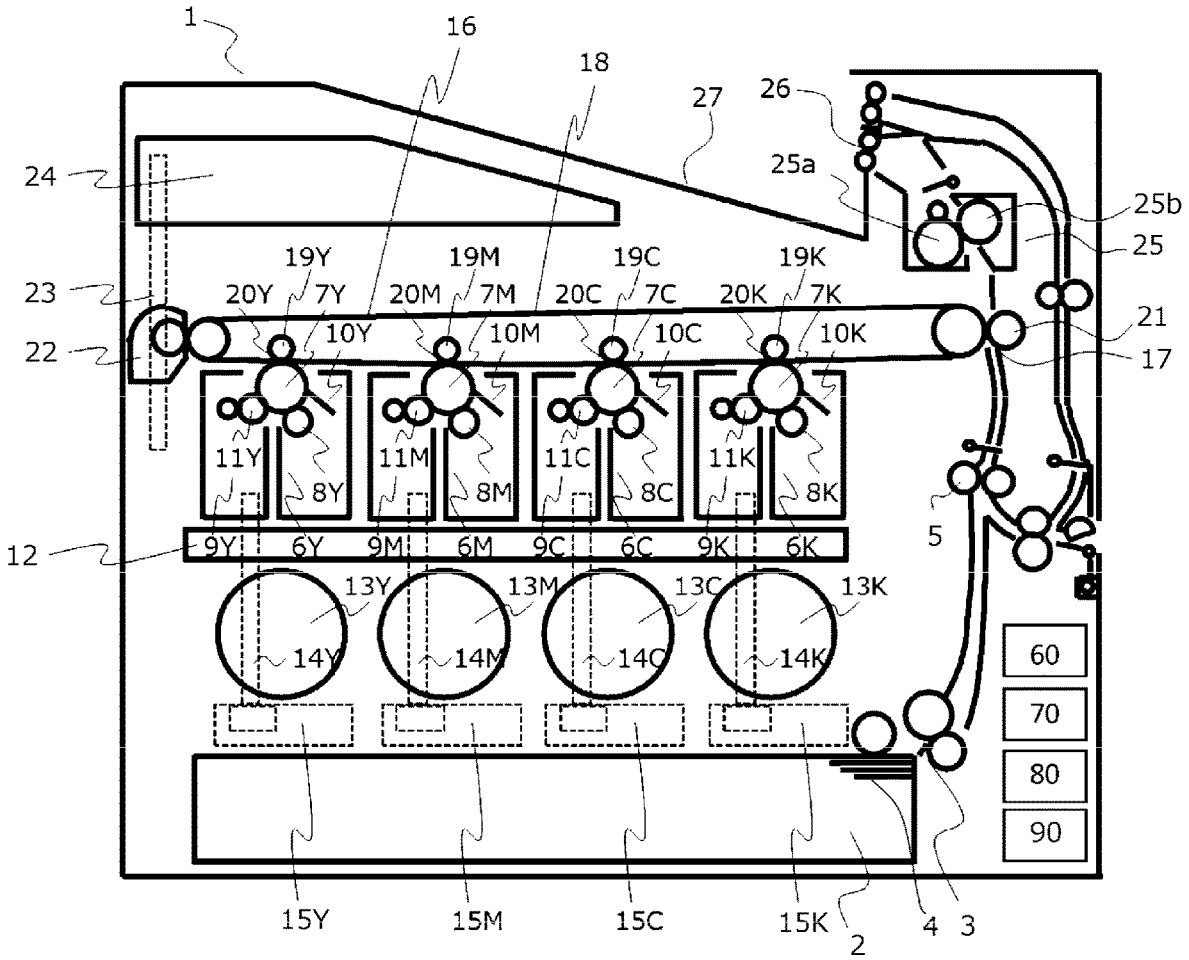
FIG. 2 is an overall cross-sectional view of an image forming apparatus.

The configuration of an image forming apparatus 1 in which the toner transport apparatus according to the present invention is applied, and an example of image forming operations, will be described with reference to the overall cross-sectional view in FIG. 2.

The image forming apparatus 1 is an apparatus which forms an image on a recording material 4 using image forming units 6 (6Y, 6M, 6C, and 6K). The letters Y, M, C, and K appended to the reference signs indicate the four colors of yellow, magenta, cyan, and black, respectively. The following descriptions will omit these letters, and refer to the image forming units simply as "image forming units 6", when there is no particular need to distinguish between the colors.

The image forming units 6 according to the present embodiment are process cartridges. The image forming units 6 (6Y, 6M, 6C, and 6K) include photosensitive drums 7 (7Y, 7M, 7C, and 7K), charging apparatuses 8 (8Y, 8M, 8C, and 8K), developing apparatuses 9 (9Y, 9M, 9C, and 9K), and cleaning blades 10 (10Y, 10M, 10C, and 10K).

Each photosensitive drum 7 is rotatably supported by a frame member of the corresponding image forming unit 6. The developing apparatuses 9 are provided with developing rollers 11 (11Y, 11M, 11C, and 11K), and each developing roller 11 is configured to be capable of making contact with and separating from the corresponding photosensitive drum 7. The developing roller 11 is rotationally driven to supply toner (developer) from the developing apparatus 9 to the photosensitive drum 7.

A control unit 60 includes a CPU, memory (this collectively refers to volatile memory and non-volatile memory), an input/output I/F, a bus, and the like, and performs various types of processing by communicating with an optical sensor unit 115, a display unit 90, and the like (described later), as well as with an external device such as an external information processing apparatus (a personal computer, a smartphone, or the like). The control unit 60 also receives image data by communicating with the exterior, reads out the received image data from the memory, and controls the various constituent elements of the image forming apparatus 1 to form an image based on the image data. The control unit 60 is a control unit constituted by a control circuit, an information processing apparatus, and the like. A power source unit 70 is a high-voltage power source that supplies power to various constituent elements of the image forming apparatus 1, such as the charging apparatuses 8 and a laser scanner unit 12. A drive unit 80 is a drive power source for driving various constituent elements of the image forming apparatus 1, and is a motor for rotationally driving the photosensitive drums 7, the developing rollers 11, an upstream-side screw 105, a downstream-side screw 124, a drive coupling 203, and various other types of rollers. The display unit 90 is a display apparatus for providing information to an operator, and any display apparatus, such as a liquid crystal panel, can be used. The display unit 90 may be configured as a touch panel so as to be capable of accepting operational inputs.

In the image forming operations, the control unit 60 causes a latent image based on the image data to be formed by causing each charging apparatus 8 to charge the surface of the corresponding photosensitive drum 7 and then irradiating the surface of the photosensitive drum with a laser using the laser scanner unit 12. Then, the latent image on the surface of the photosensitive drum is visualized as a toner image by the developing roller 11 supplying toner to the photosensitive drum 7. The developed toner image is transferred to an intermediate transfer belt 18 at a primary transfer part 20. Y, M, C, and K toner images are transferred consecutively to form a four-color toner image on the surface of the intermediate transfer belt 18. The four-color toner image is transported to a secondary transfer part 17 by the intermediate transfer belt 18 rotating.

Toner resupply cartridges 13 (13Y, 13M, 13C, and 13K), toner transport apparatuses 14 (14Y, 14M, 14C, and 14K), and toner transport drive apparatuses 15 (15Y, 15M, 15C, and 15K) are disposed below the image forming units 6 (6Y, 6M, 6C, and 6K), respectively. Each toner transport apparatus 14 functions as a transport path unit, and is driven by the corresponding toner transport drive apparatus 15 to transport and resupply toner to the image forming unit 6 from the toner resupply cartridge 13 as toner is consumed by the image forming unit 6.

A cassette 2 is provided in a lower part of the image forming apparatus 1, and the recording material 4, which is paper or the like, is held in the cassette 2. A cassette feed part 3 separates and feeds one sheet of the recording material 4 at a time by rotating, and that sheet is transported downstream by resist rollers 5.

An intermediate transfer unit 16 is provided above the developing apparatuses 9. The intermediate transfer unit 16 includes the intermediate transfer belt 18, primary transfer rollers 19, stretching rollers, and so on. The intermediate transfer unit 16 may be made removable from the image forming apparatus itself. The intermediate transfer unit 16 is disposed substantially horizontally so that the secondary transfer part 17 faces the transport path of the recording material 4.

The intermediate transfer belt 18, which opposes the photosensitive drums 7, is an endless belt capable of rotating, and is stretched upon a plurality of stretching rollers. On the inner surface of the intermediate transfer belt 18, the primary transfer rollers 19 (19Y, 19M, 19C, and 19K) are disposed opposite the photosensitive drums 7 (7Y, 7M, 7C, and 7K), respectively, with the intermediate transfer belt 18 located between the primary transfer rollers 19 and the photosensitive drums 7. The primary transfer parts 20 (20Y, 20M, 20C, and 20K) are formed between the primary transfer rollers 19 and the photosensitive drums 7. At each primary transfer part 20, a voltage is applied to the primary transfer roller 19 and the toner image is transferred onto the intermediate transfer belt 18 from the photosensitive drum 7.

The intermediate transfer belt 18 is interposed between a secondary transfer roller 21, which is a secondary transfer member, and a secondary transfer opposing roller 31, forming the secondary transfer part 17. The toner images transferred onto the intermediate transfer belt 18 undergo a secondary transfer to the recording material 4 at the secondary transfer part 17. Toner which could not be completely transferred onto the recording material 4 during the secondary transfer and which therefore remains on the intermediate transfer belt 18 is removed by a cleaning unit 22. The toner removed by the cleaning unit 22 is transported to and accumulated in a toner collection receptacle 24 via a collected toner transport unit 23.

Having undergone the secondary transfer of the toner image, the recording material 4 is transported further downstream (upward, in FIG. 2), and is compressed and heated by a heating unit 25*a* and a pressure roller 25*b* of a fixing apparatus 25. This melts the toner and fixes the toner image onto the recording material 4. The recording material 4 is then transported to a discharge roller pair 26, and is discharged to a paper discharge tray 27. The foregoing series of operations are the image forming operations for forming an image on the surface of a recording material.

Configuration for Toner Resupply

Figure 3A:
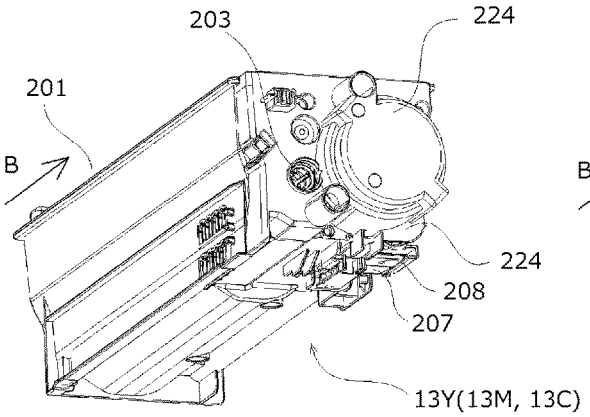
FIGS. 3A to 3D are perspective views of a toner resupply cartridge, seen from one end of the cartridge.
Figure 3B:
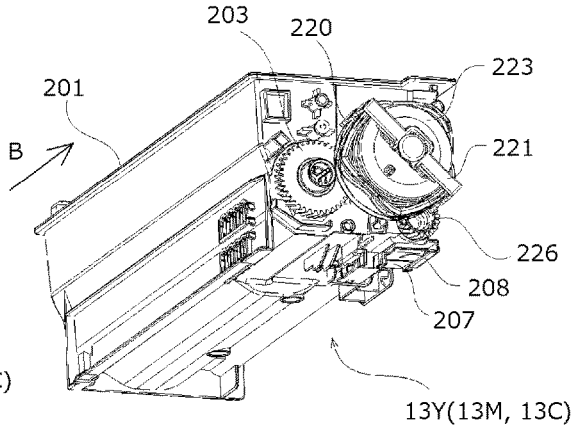
Figure 3C:
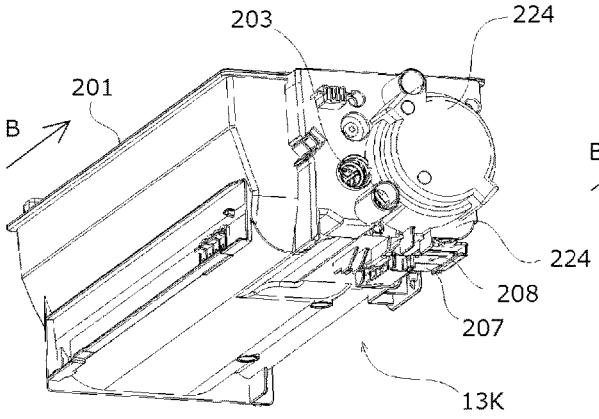
Figure 3D:
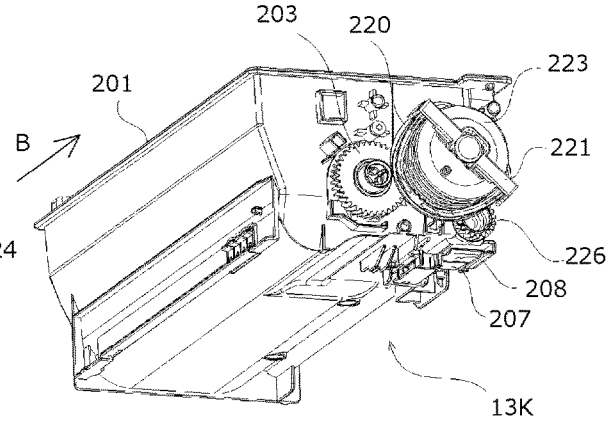

The toner resupply cartridge 13, and a configuration for transporting the toner, which are characteristic configurations of the present embodiment, will be described next with reference to FIGS. 3A to 4C. FIG. 3A is a perspective view of the toner resupply cartridges 13Y, 13M, and 13C. In FIGS. 3A to 3D, the direction indicated by arrow B is an insertion direction when mounting the toner resupply cartridge 13 to the main body of the image forming apparatus. Conversely, the direction opposite from arrow B is the direction in which the toner resupply cartridge 13 is removed from the main body of the image forming apparatus. FIG. 3B is a perspective view of a state where a side cover 224 has been removed from the cartridge illustrated in FIG. 3A. FIG. 3C is a perspective view of the toner resupply cartridge 13K, and FIG. 3D is a perspective view of a state where the side cover 224 has been removed from the cartridge illustrated in FIG. 3C.

Figure 4A:
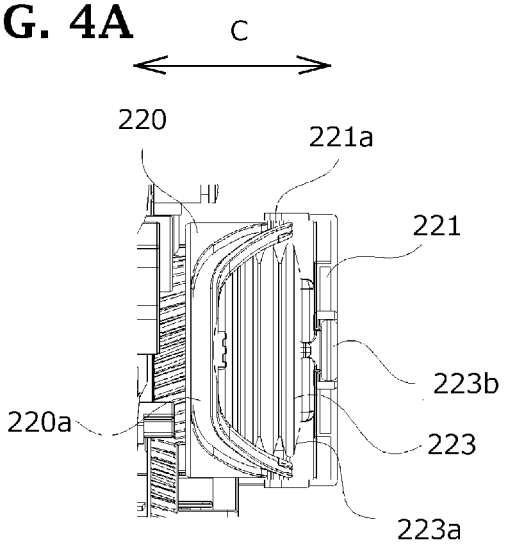
FIGS. 4A to 4C are diagrams illustrating a mechanism for driving a pump.
Figure 4B:
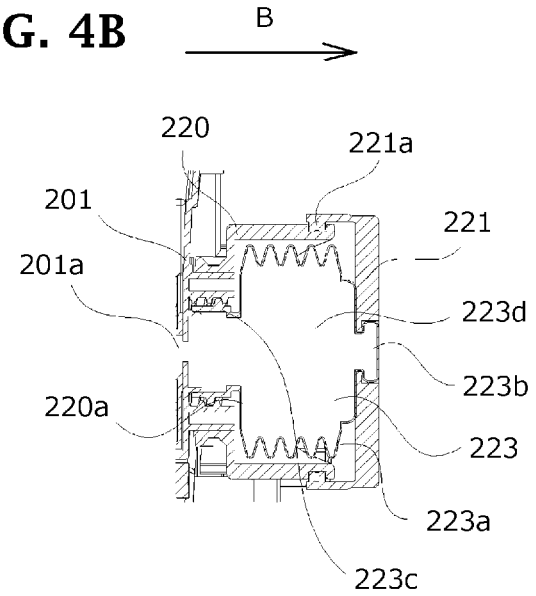
Figure 4C:
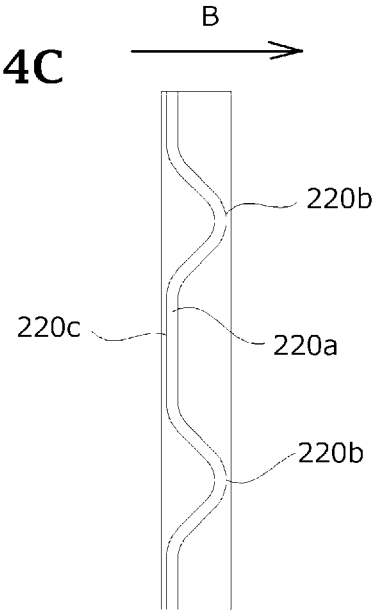

FIGS. 4A to 4C are diagrams illustrating the configuration of a cam for outputting toner, and illustrate one end of the toner resupply cartridge. FIG. 4A is a diagram illustrating the configurations of a cam gear 220, a link mechanism 221, and a pump 223. FIG. 4B is a cross-sectional view of the configuration illustrated in FIG. 4A. FIG. 4C is an expanded view of a cam groove 220*a* in the cam gear 220.

As illustrated in FIGS. 3A to 3D, the toner resupply cartridge 13 includes a substantially rectangular resupply frame member 201 having a longer direction and a shorter direction. The resupply frame member 201 is capable of housing toner therein. The drive coupling 203, the cam gear 220, the link mechanism 221, the pump 223, and a screw gear 226 are disposed on the downstream side of the toner resupply cartridge 13 in the mounting direction (the direction indicated by arrow B), and are covered by the side cover 224. A discharge shutter 207 provided with a discharge port 208 is disposed on a bottom surface side (a lower side, when in an orientation for normal use). A gear part of the cam gear 220 meshes with the screw gear 226, and the screw gear 226 receives rotational driving force from the cam gear 220. As such, the screw gear 226 rotates along with the cam gear 220.

The drive coupling 203 is disposed so as to transmit drive power to the cam gear 220 and to a toner resupply screw 209 located within the resupply frame member 201. When the toner resupply cartridge 13 is mounted in the image forming apparatus 1, the drive coupling 203 engages with a main body-side drive coupling (not shown). Drive power from the drive unit 80 is transmitted to the toner resupply cartridge side as a result.

Figure 5:
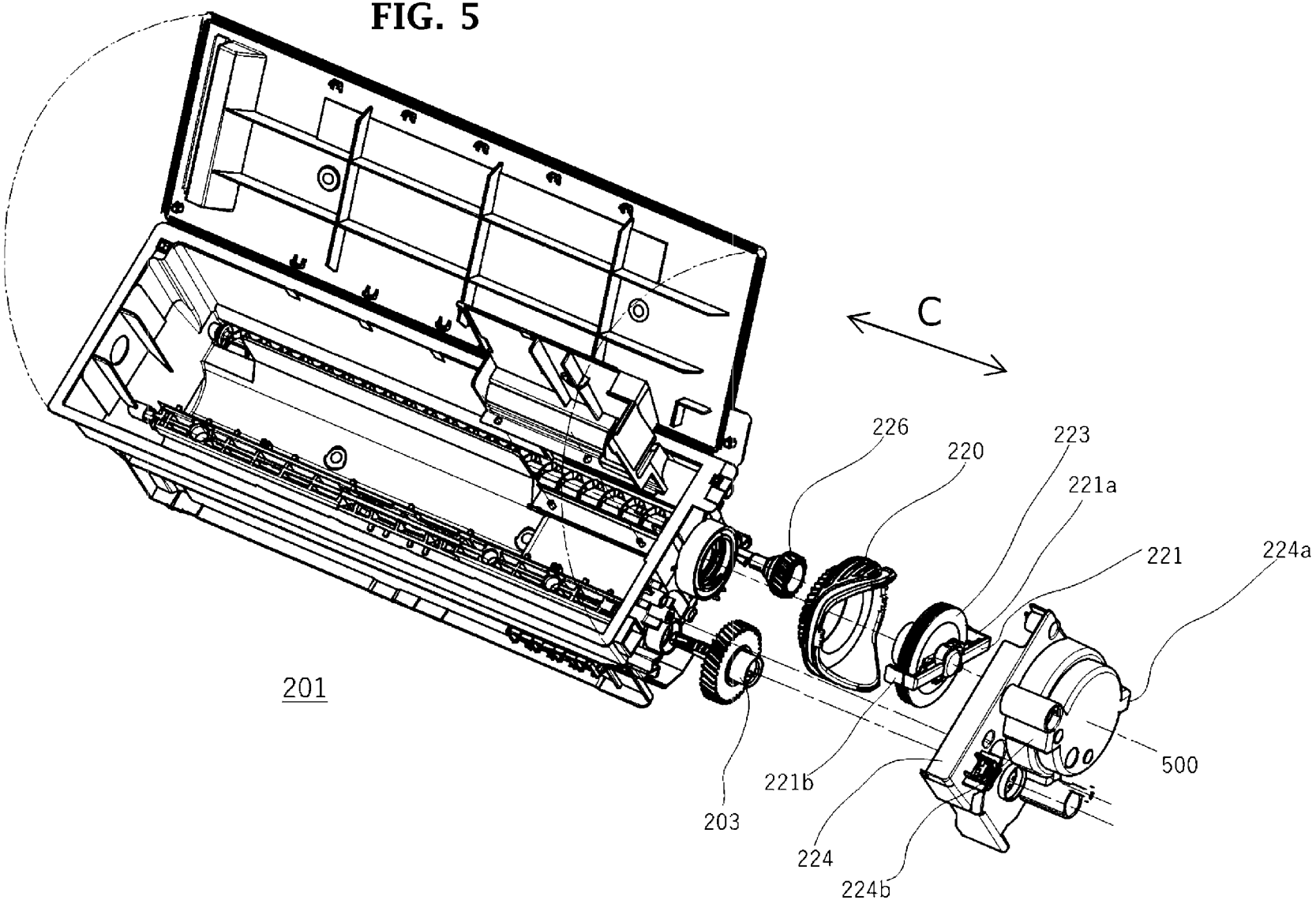
FIG. 5 is an exploded perspective view of the toner resupply cartridge.

As illustrated in FIGS. 4A to 4C, the cam gear 220 is provided with the cam groove 220*a*, and a cam projection 221*a* of the link mechanism 221 fits with the cam groove 220*a*. Both ends of the link mechanism 221 are guided, and are furthermore supported so as to be capable of moving to and from relative to the side cover 224 in the direction indicated by arrow C, by guides 224*a* and 224*b* of the side cover 224 (see FIG. 5). As illustrated in FIG. 5, the guides 224*a* and 224*b* correspond to protruded portions of the side cover 224. A space is formed within the protruded portions, and end parts 221*a* and 221*b* of the link mechanism 221 are disposed within that space. Accordingly, the position of the link mechanism 221 is restricted by the guides 224*a* and 224*b* such that the link mechanism 221 can move in the direction indicated by arrow C, but rotational movement of link mechanism 221 about an axis 500 is restricted. The cam groove 220*a* is provided with peak parts 220*b*, which are sloped toward the downstream side in the mounting direction (the direction of arrow B), and a valley part 220*c*, which is sloped toward the upstream side in the mounting direction (the direction of arrow B). According to this structure, when the cam gear 220 rotates, the cam projection 221*a*, which is fitted into the cam groove 220*a*, passes the peak parts 220*b* and the valley part 220*c* in an alternating manner. The rotational movement of the gear is converted into forward and backward movement of the link mechanism as a result, which causes the link mechanism 221 to move back and forth in the mounting direction (the direction indicated by arrow B).

Here, one end of the pump 223 in the mounting direction is connected to the link mechanism 221 by a joining part 223*b*. The other end of the pump 223 in the mounting direction is fixed to the resupply frame member 201 by a connecting part 223*c*. Additionally, an inner space 223*d* of the pump 223 communicates with an inner space of the resupply frame member 201 (i.e., a toner storage chamber 201*a* which serves as a storage part and stores toner) via the connecting part 223*c*.

Figure 8A:
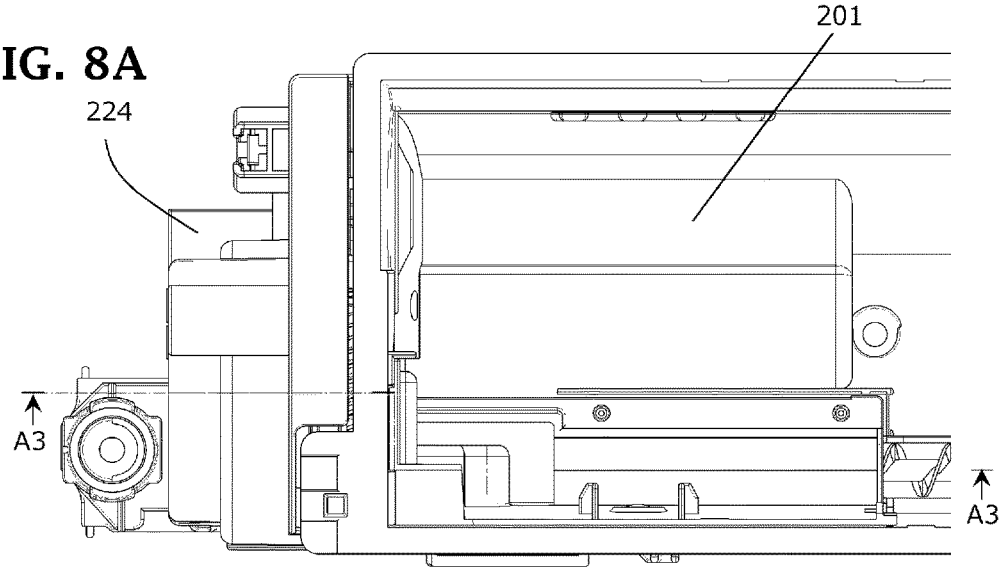
FIGS. 8A to 8C are diagrams illustrating the output of toner from the cartridge.
Figure 8B:
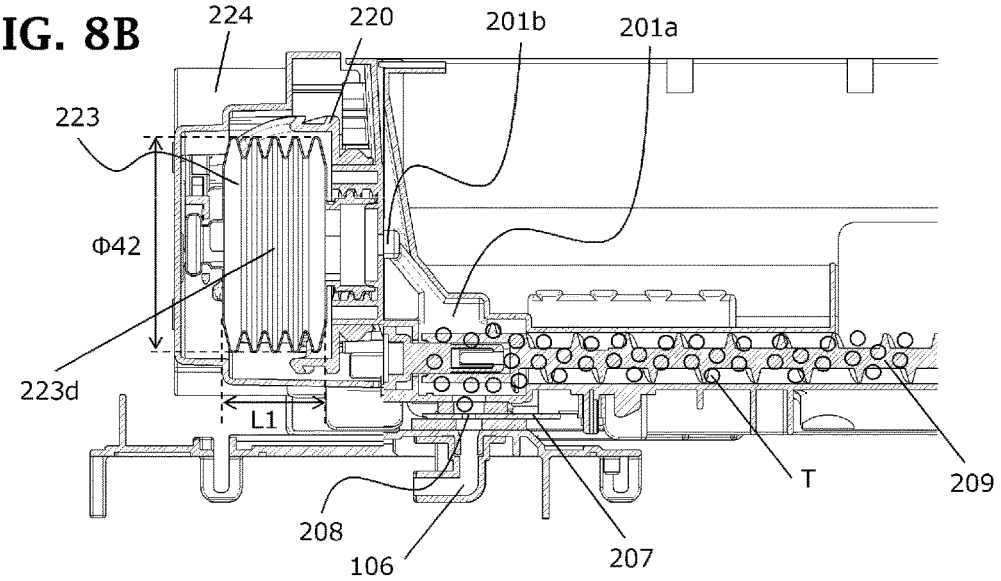

According to this configuration, the connecting part 223*c* of the pump 223 is fixed to the resupply frame member 201, and thus when the joining part 223*b* of the pump 223 moves back and forth in tandem with the link mechanism 221, a bellows part 223*a* of the pump 223 expands and contracts (see FIGS. 8A and 8B). This expansion and contraction causes the volume of the inner space 223*d* of the pump 223 to change, and an internal pressure of the toner storage chamber 201*a*, which communicates with the inner space 223*d*, fluctuates as a result. This imparts the toner with kinetic energy, and the toner is discharged from the discharge port 208. Note that the output means is not limited to a pump, and any means may be used as long as it is capable of outputting the toner by imparting kinetic energy.

Figure 6:
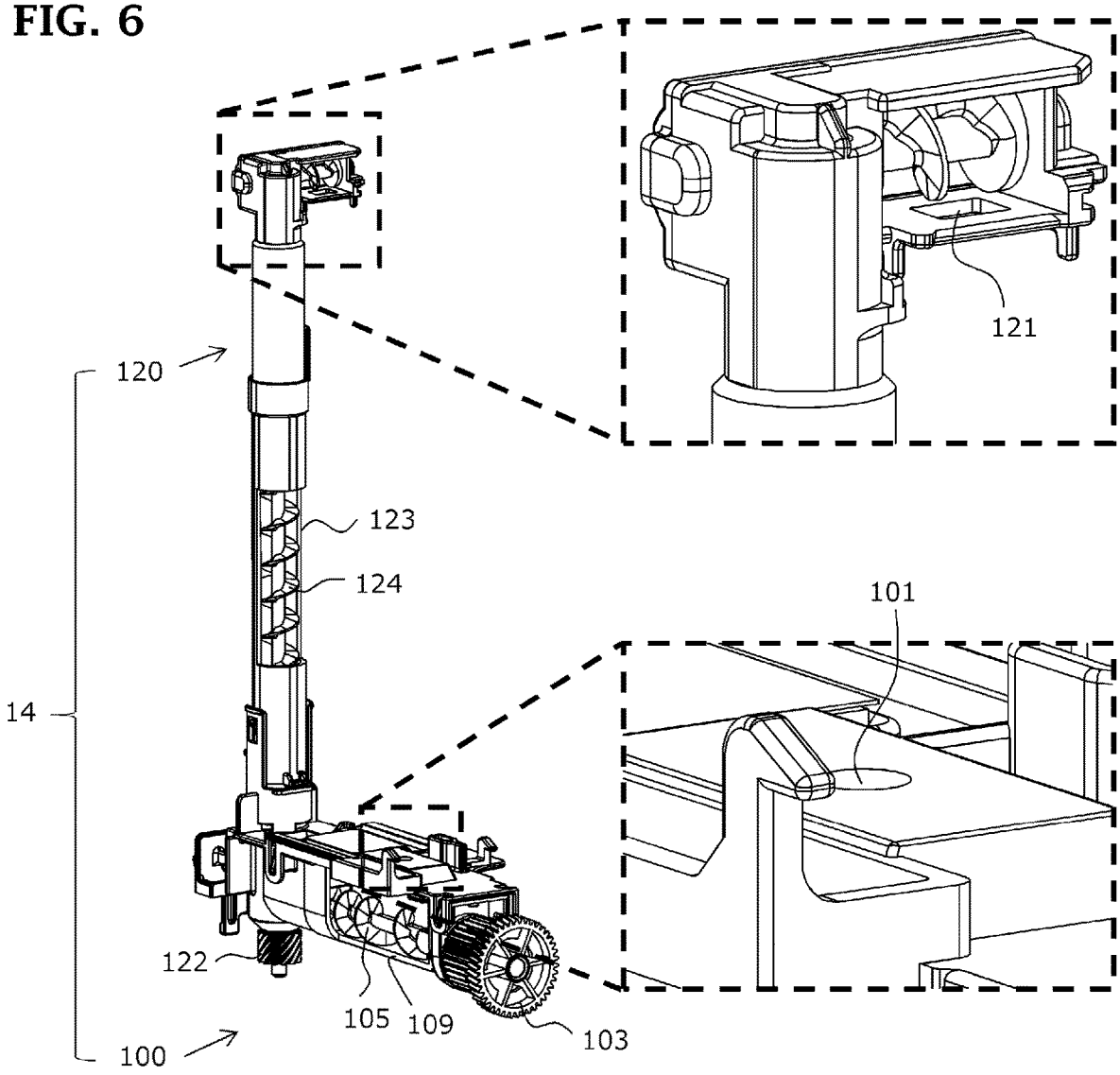
FIG. 6 is a perspective view illustrating the overall configuration of a toner transport apparatus.

FIG. 6 illustrates the overall configuration of the toner transport apparatus 14 provided in the image forming apparatus. Note that FIG. 6 omits part of the shape of the toner transport apparatus 14 in order to show the internal configuration thereof. The configuration of the toner transport apparatus 14 is broadly divided into an upstream-side transport portion 100 and a downstream-side transport portion 120.

A feeding port 101 is formed in an upper surface of the upstream-side transport portion 100. Toner supplied from the toner resupply cartridge 13 passes through the feeding port 101 and is supplied to a storage receptacle 108 within the upstream-side transport portion 100. The upstream-side transport portion 100 includes the upstream-side screw 105, which is disposed so as to be covered by the storage receptacle 108. Toner which has dropped from the feeding port 101 is distributed throughout the area where the upstream-side screw 105 is disposed. The toner is then transported in the direction of the downstream-side transport portion 120 by the upstream-side screw 105, which is rotationally driven by an upstream-side driving gear 103.

The downstream-side transport portion 120 includes a downstream-side wall surface 123. The downstream-side screw 124 is disposed so as to be covered by the downstream-side wall surface 123. A part of the downstream-side transport portion 120 furthest on the upstream side (a lower part in FIG. 6) is connected to a part of the upstream-side transport portion 100 furthest on the downstream side, and the toner transported by the upstream-side transport portion 100 is transported to the downstream-side screw 124. The downstream-side screw 124 is rotationally driven by a downstream-side drive gear 122, and transports toner in the direction opposite from the gravitational direction. The toner transported by the downstream-side screw 124 is supplied to the developing apparatus 9 through a main body discharge port 121.

Detailed Description of Upstream-Side Transport Unit 100

Figure 1A:
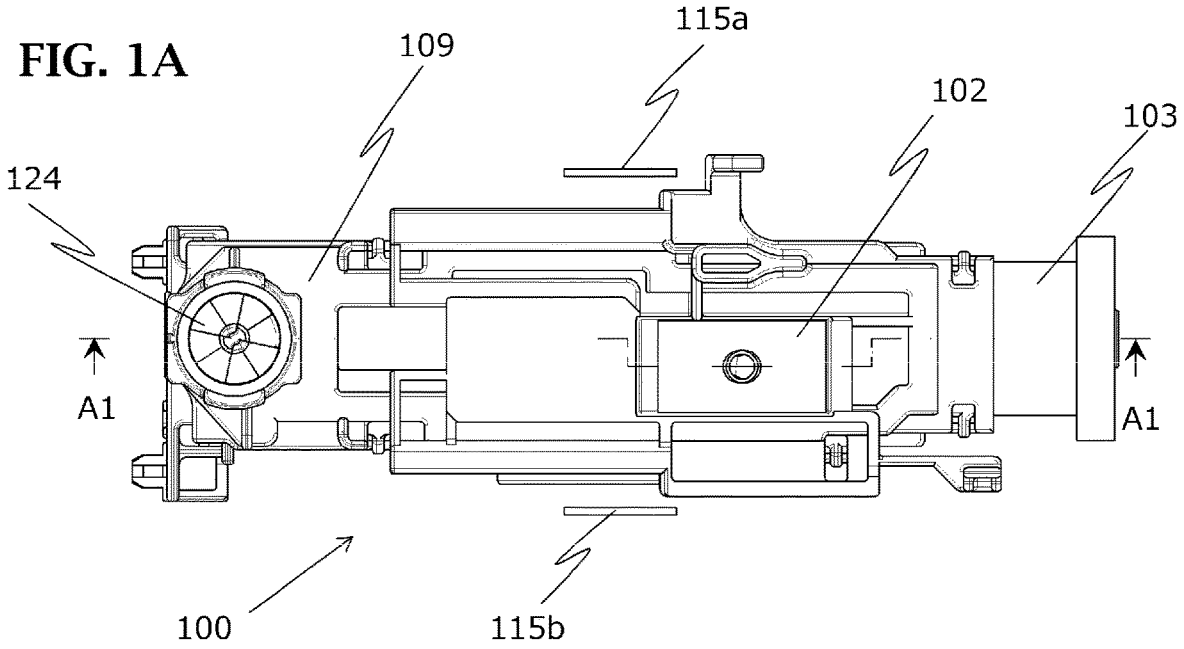
FIGS. 1A and 1B are a plan view and a cross-sectional view, respectively, of an upstream-side transport portion.
Figure 1B:
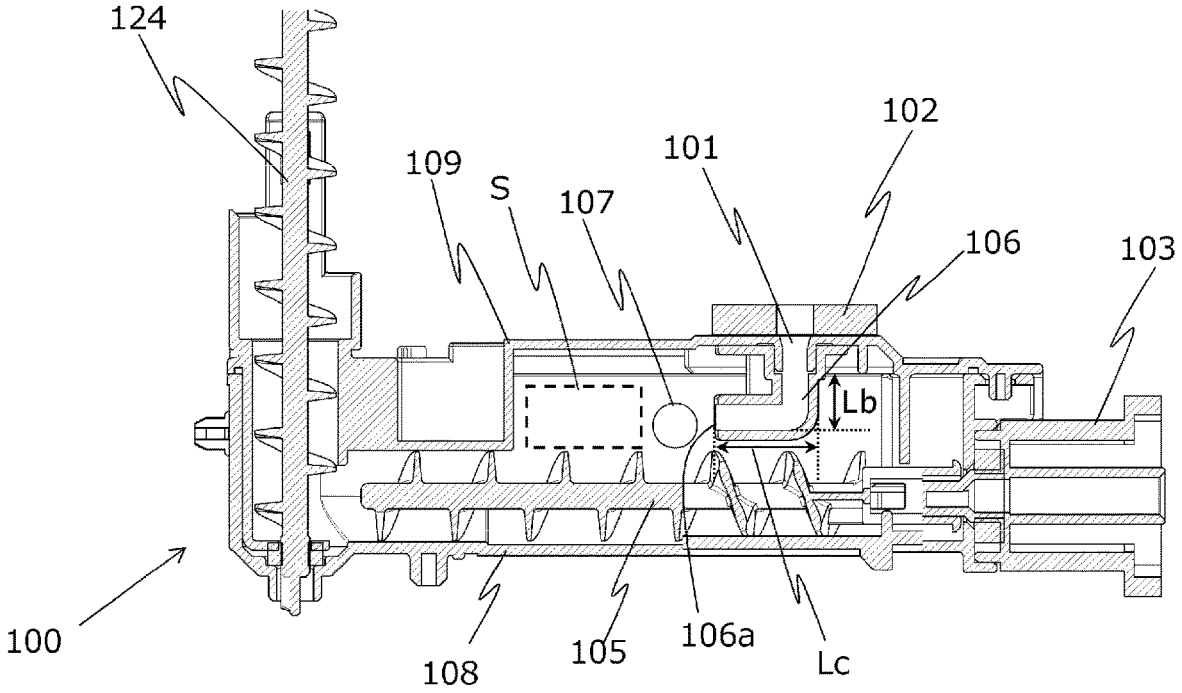
Figure 7A:
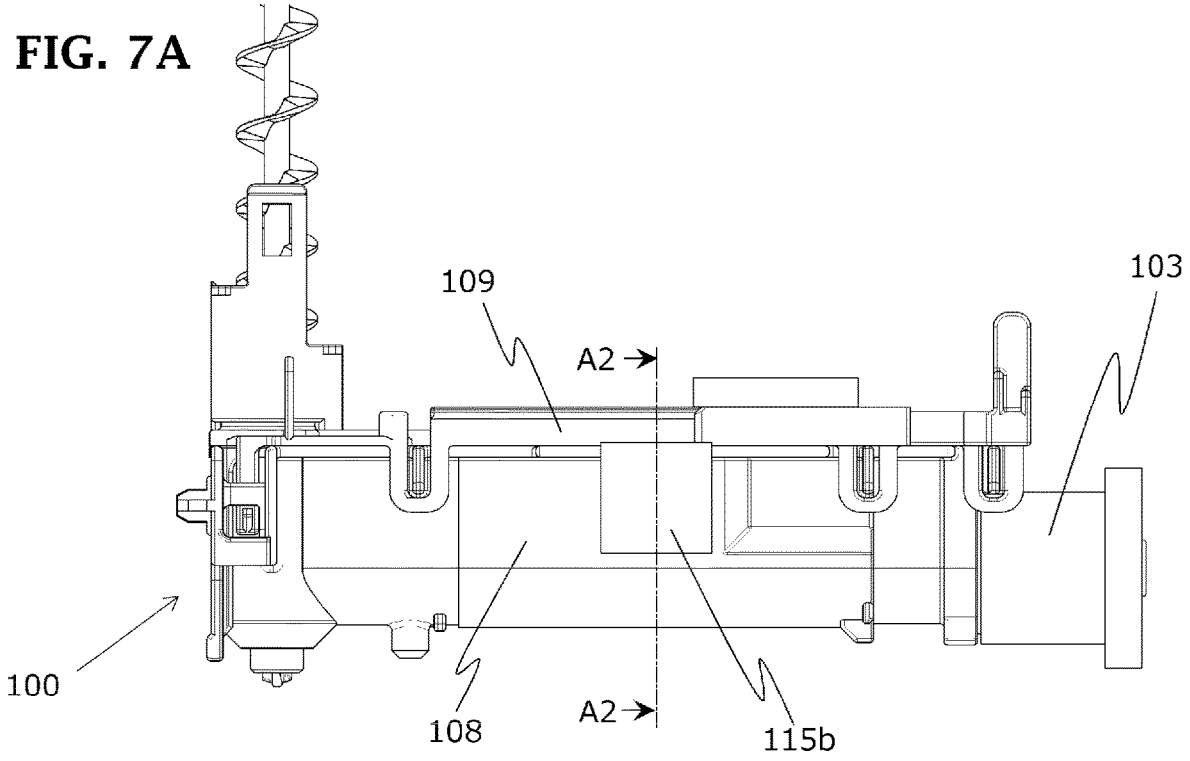
FIGS. 7A and 7B are a side view and a cross-sectional view of part of the toner transport apparatus.
Figure 7B:
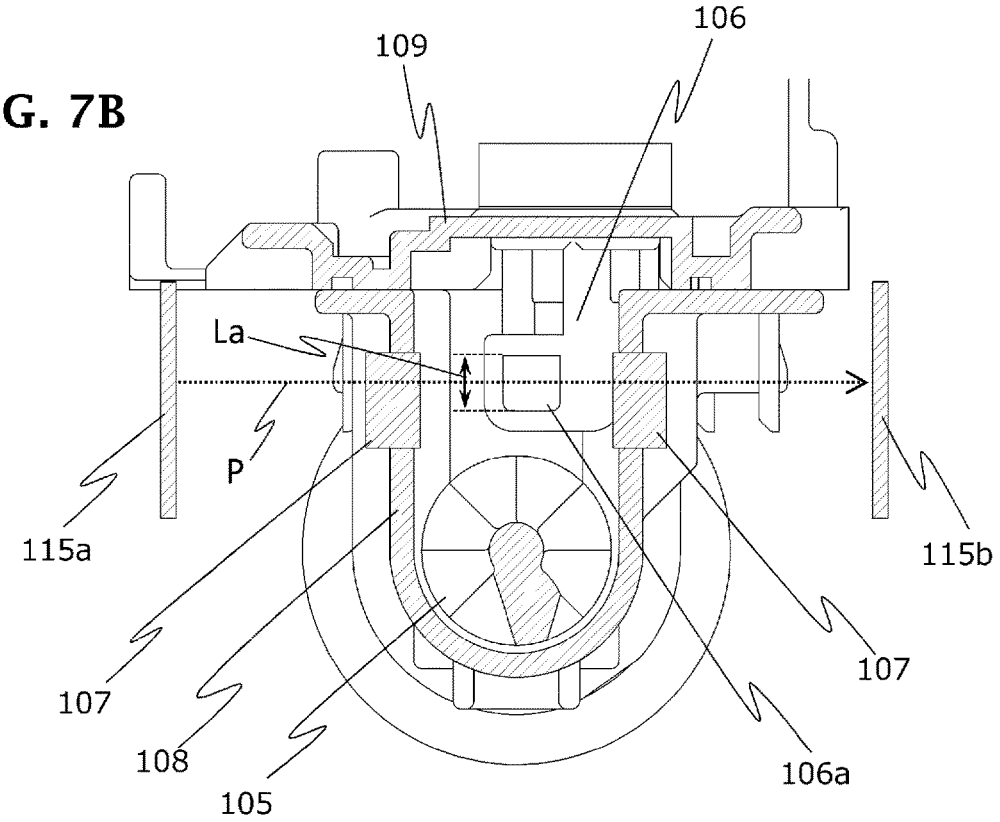

The toner transport apparatus 14 will be described in detail next with reference to FIGS. 1A, 1B, 7A, and 7B. FIG. 1A is a diagram illustrating the upstream-side transport portion 100 from above. FIG. 1B is a cross-sectional view taken along a line A1-A1 in FIG. 1A. FIG. 7A is a diagram illustrating the upstream-side transport portion 100 from the side. FIG. 7B is a cross-sectional view taken along a line A2-A2 in FIG. 7A.

As illustrated in FIG. 1B, the configuration of the upstream-side transport portion 100 can be broadly divided into the storage receptacle 108, which serves as a toner receiving part, and a storage receptacle cover 109. The storage receptacle 108 and the storage receptacle cover 109 are basically constituted by wall surfaces formed from at least one resin frame. A feeding port seal 102 is affixed to an upper part of the feeding port 101, which is formed in the storage receptacle cover 109, and the feeding port seal 102 seals the periphery of the feeding port 101 to prevent toner scattering. An L-shaped channel 106, serving as a toner channel, is attached to a bottom part of the feeding port 101. The L-shaped channel 106 includes a substantially vertical portion which connects to the feeding port 101, and a substantially horizontal portion which connects the substantially vertical portion to an ejection port 106*a*. With this configuration, toner which has been resupplied from the feeding port 101 is ejected toward a space S located in an extension of the substantially horizontal portion of the L-shaped channel 106. In this manner, the L-shaped channel 106 forms the ejection port 106*a*. The ejected toner falls downward while passing through this passage area and accumulates in a bottom part of the storage receptacle 108.

As illustrated in FIG. 7B, light-transmissive members 107, serving as a pair of light-transmissive portions, are attached to side walls of the storage receptacle 108, near the ejection port 106*a* in the L-shaped channel 106. In the embodiment, the pair of light-transmissive members 107 are disposed on both side surfaces of the storage receptacle 108, which serves as a housing. A direction connecting the pair of light-transmissive members 107 and a direction in which toner is ejected toward the space S from the ejection port 106*a* in the L-shaped channel 106 intersect in the toner passage area.

The optical sensor unit 115 includes a light-emitting substrate 115*a*, serving as a light-emitting unit and including a light-emitting element and driving circuitry thereof, and a light-receiving substrate 115*b*, serving as a light-receiving unit and including a photo acceptance unit and driving circuitry thereof. The light-emitting substrate 115*a* of the optical sensor unit 115 is provided on the outer side of one of the pair of light-transmissive members 107. The light-receiving substrate 115*b* is provided on the outer side of the other light-transmissive member 107. In other words, the light-emitting substrate 115*a*, one of the light-transmissive members, the toner passage area, the other of the light-transmissive members, and the light-receiving substrate 115*b* are disposed in that order in the direction connecting the pair of light-transmissive members 107. According to this structure, an optical path P from the light-emitting substrate 115*a* to the light-receiving substrate 115*b* intersects with the toner passage area.

As a result, toner can be detected by the optical sensor unit 115, which makes it possible to determine whether or not there is toner. In other words, if there is no toner in the optical path P, through which light emitted from the light-emitting substrate 115*a* under the control of the control unit 60 reaches the light-receiving substrate 115*b* via the pair of light-transmissive members 107, and the light-receiving substrate 115*b* has therefore detected the light, the control unit 60 can determine that no toner is present. On the other hand, if the light is blocked by the toner and the light-receiving substrate 115*b* cannot detect the light under predetermined conditions, the control unit 60 can determine that toner is present. Note that the control unit 60 may perform the determination in accordance with the optical intensity of the light reaching the light-receiving substrate 115*b*.

A light-emitting diode (LED) which emits light such as infrared light can be used as the light-emitting element included in the light-emitting substrate 115*a*, for example. However, the wavelength range of the light is not limited thereto, and the light may be visible light instead. Another light source member, such as a semiconductor laser (LD), may be used instead of an LED. A known light-receiving substrate, e.g., a photosensor, can be used as the photo acceptance unit included in the light-receiving substrate 115*b*. Any other optical sensor can be used as well, as long as the sensor can determine whether or not an object is present in an optical path using light.

A material which is transmissive with respect to the wavelength range of the light emitted from the light-emitting substrate 115*a*, e.g., an acrylic resin, can be used favorably as the light-transmissive members 107. The light-transmissive members 107 may have any shape and be provided in any position as long as the optical path can be formed in the passage area through which the toner passes when falling, i.e., may be non-circular. Additionally, for the purpose of defining the optical path, optical members such as rod-shaped lenses made of an acrylic resin may be used as the light-transmissive members 107, or optical members may be disposed in the vicinity of the light-transmissive members 107.

An optical intensity at which the light-receiving substrate 115*b* receives light when the light-emitting substrate 115*a* emits light at a predetermined optical intensity is stored in the memory of the control unit 60 in advance. Whether or not toner is present in the passage area is then determined by comparing the optical intensity at which the light-receiving substrate 115*b* receives light with the stored optical intensity when the light is emitted. In other words, when light having at least a predetermined optical intensity has been received by the light-receiving substrate 115*b*, the control unit 60 determines that there is no toner or that there is almost no toner, and executes predetermined processing. Alternatively, time information on the time at which the light-receiving substrate 115*b* receives light when the light-emitting substrate 115*a* emits light at a predetermined optical intensity is stored in the memory of the control unit 60 in advance. In this case, whether or not toner is present in the passage area is determined in accordance with the length of a time, in a predetermined period, for which the light-receiving substrate 115*b* receives light, in excess of a threshold time. In other words, when light has been received by the light-receiving substrate 115*b* for at least a predetermined time, the control unit 60 determines that there is no toner or that there is almost no toner, and executes predetermined processing.

Here, the predetermined processing executed by the control unit 60 when it is determined that there is no toner or there is almost no toner includes, for example, displaying a message prompting the toner resupply cartridge to be replaced in the display unit 90.

As illustrated in FIG. 7B, in the present embodiment, the ejection port 106*a* in the L-shaped channel 106 has a square cross-sectional shape, with one side La being 3.5 mm. Furthermore, as illustrated in FIG. 1B, the L-shaped channel 106 has a vertical channel length Lb of 7.6 mm, and a horizontal channel length Lc of 12.5 mm. Although the cross-sectional shape of the L-shaped channel 106 is described as being a square in the present embodiment, another shape may be used instead, such as a rectangle or a circle. The vertical and horizontal channel lengths may be changed in accordance with the size, shape, and so on of the cross-sectional shape. It is desirable that the cross-sectional shape be set to an optimal shape in accordance with the size and arrangement of the light-transmissive members 107, the detection range of the optical sensor, and so on.

Figure 8C:
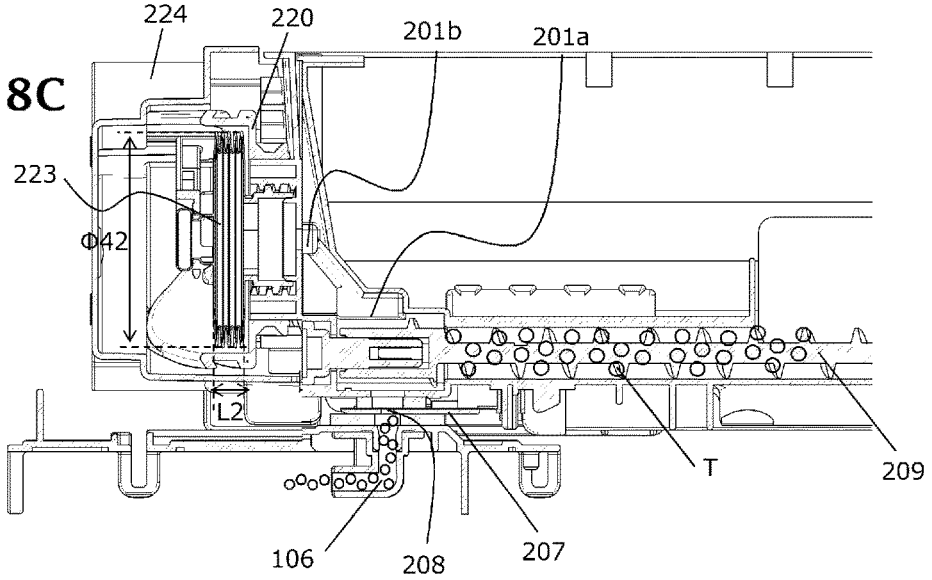
Figure 9A:
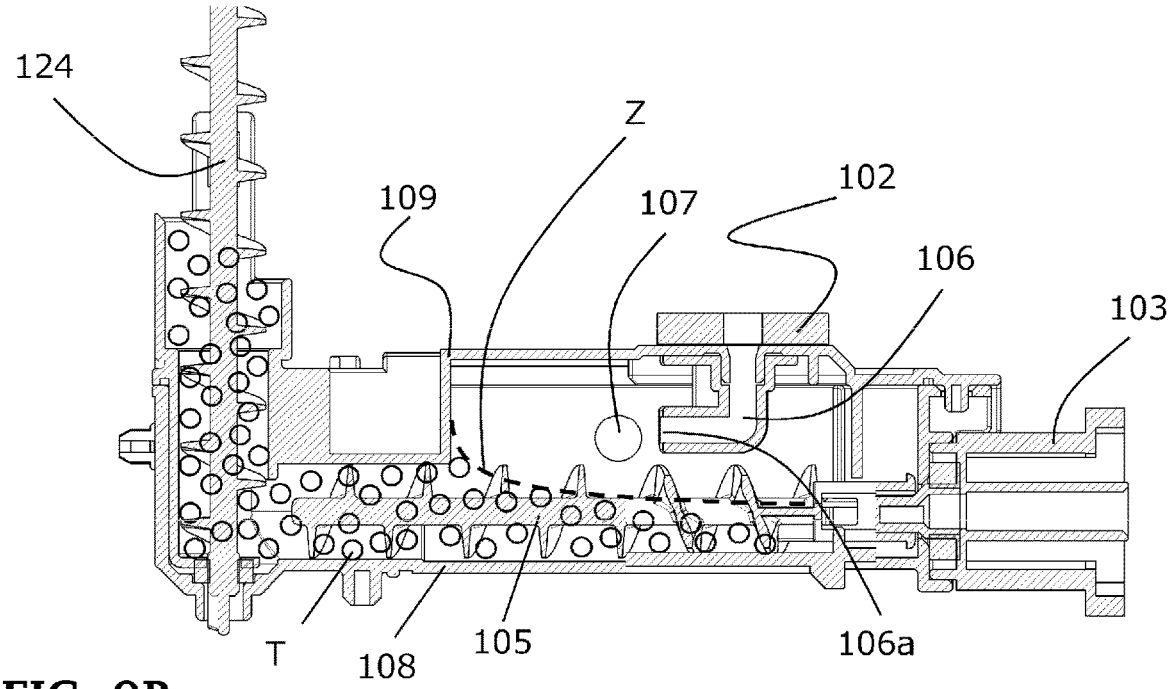
FIGS. 9A and 9B are diagrams illustrating the behavior of the output toner.
Figure 9B:
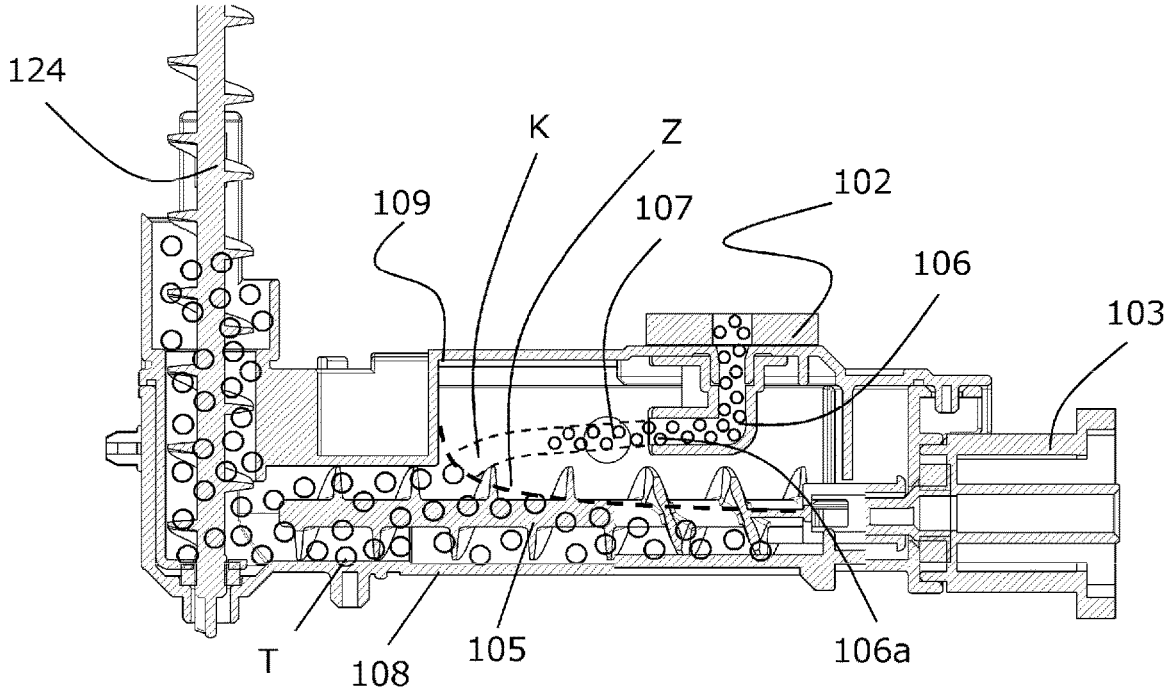

Method for Detecting Remaining Amount During Operations Performed when Resupplying Toner A method for detecting the remaining toner amount during operations for resupplying toner from the toner resupply cartridge 13 will be described next with reference to FIGS. 8A to 8C and 9A to 9B. FIG. 8A is a diagram illustrating the interior of the toner resupply cartridge 13 from above. FIGS. 8B and 8C are cross-sectional views taken along a line A3-A3, and illustrate toner T. FIG. 8B illustrates the pump 223 in an expanded state, and FIG. 8C illustrates the pump 223 in a contracted state. FIGS. 9A and 9B are, like FIG. 1B, cross-sectional views taken along the line A1-A1 in FIG. 1A. FIG. 9A corresponds to FIG. 8B, and FIG. 9B to FIG. 8C.

As described above, when the amount of toner remaining in the developing apparatus decreases or decreases from a predetermined amount, the control unit 60 performs control so that the developing apparatus 9 is resupplied with toner from the toner resupply cartridge 13. The control unit 60 obtains the amount of toner remaining in the developing apparatus 9 through a given method, such as optical detection or weight-based detection, and sends a resupply signal to the toner transport apparatus side when the remaining amount has reached zero or has dropped below a predetermined threshold. As illustrated in FIGS. 8B and 8C, when the resupply signal is received on the toner transport apparatus side, the cam gear 220, which is arranged coaxially with the drive coupling 203 (not shown) and the pump 223, rotates, causing the pump 223 to repeatedly expand and contract between an expanded state (FIG. 8B) and a contracted state (FIG. 8C).

As illustrated in FIG. 8B, the inner space 223*d* of the pump 223 and the toner storage chamber 201*a* communicate via a communication port 201*b*. Accordingly, when the pump 223 contracts as illustrated in FIG. 8C, the internal pressure of the toner storage chamber 201*a* rises, and the toner T, which has been transported into the toner storage chamber 201*a* by the toner resupply screw 209, can be discharged from the discharge port 208. As illustrated in FIGS. 8B and 8C, in the present embodiment, the pump has a diameter Φ of 42 mm, a length L1 of 20.1 mm in a no-load state (the expanded state), a length L2 of 8.1 mm in the contracted state, and an expansion/contraction stroke of 12 mm. One expansion/contraction cycle T of the pump is 0.38 sec. Using such a pump shape and design specifications makes it possible to discharge the toner T in the toner storage chamber 201*a* via the L-shaped channel 106 of the upstream-side transport portion 100.

The supply of the toner in the upstream-side transport portion 100 will be described next with reference to FIGS. 9A and 9B. FIG. 9A illustrates a state where toner is not being resupplied from the toner resupply cartridge 13, and FIG. 9B illustrates a state where toner is being resupplied from the toner resupply cartridge 13.

As illustrated in FIG. 9A, when no toner is being resupplied, a set amount of toner is held within the storage receptacle 108. The surface of the toner in the storage receptacle 108 at this time will be called a "toner surface Z". The toner surface Z is defined by the structure of the inner surface of the storage receptacle 108, the configuration and performance of the upstream-side screw 105, and the like. In the state illustrated in FIG. 9A, the light-transmissive members 107 and the toner surface Z do not overlap when viewed from the perspective illustrated in the drawing.

When the resupply of the toner begins, the state transitions to that illustrated in FIG. 9B, with the toner within the toner storage chamber 201*a* being discharged into the storage receptacle 108 via the L-shaped channel 106. Here, a trajectory along which the toner discharged from the ejection port 106*a* in the L-shaped channel 106 drops to the toner surface Z in the storage receptacle 108 will be called a "toner drop trajectory K". Upper and lower ends of the toner drop trajectory K in the vertical direction are indicated by broken lines in FIG. 9B. Assuming the trajectory of the toner ejected from the upper end is a first trajectory and the trajectory of the toner ejected from the lower end is a second trajectory, a range enclosed within the first trajectory, the second trajectory, the ejection port 106*a*, and the toner surface Z corresponds to the passage area through which the toner passes while dropping after being ejected. The light-transmissive members 107 are disposed so as to be projected onto at least one of the first trajectory and the second trajectory when viewed from the perspective illustrated in the drawing. Preferably, the light-transmissive members 107 are disposed so as to be projected onto both the first trajectory and the second trajectory.

Preferably, when projected onto the passage area as seen from a direction intersecting with the direction in which the toner is ejected, the pair of light-transmissive portions are disposed so as to overlap with a region enclosed within (i) the first trajectory, (ii) the second trajectory, (iii) a line connecting the upper and lower ends of the ejection port, and (iv) a wall surface of the receiving part. This ensures that the optical path of the optical sensor overlaps with the toner passage area.

To take this from a different perspective, preferably, when projected onto the passage area as seen from a direction intersecting with the direction in which the toner is ejected, the light-receiving unit is disposed so as to overlap with the region enclosed within (i) the first trajectory, (ii) the second trajectory, (iii) a line connecting the upper and lower ends of the ejection port, and (iv) a wall surface of the receiving part. This also ensures that the optical path of the optical sensor overlaps with the toner passage area.

Through this configuration, the optical sensor can detect the presence/absence of toner discharged from the ejection port 106*a*, via the light-transmissive members 107. If no toner is discharged from the ejection port 106*a* despite resupply operations being performed, the control unit 60 can determine that the toner within the toner resupply cartridge 13 has been exhausted. This makes it possible to quickly determine that there is no toner left in the developer container. Note that if the light-transmissive members 107 have a function for focusing light, and an optical member which reflects the focused light onto a given position is furthermore provided, it is not necessary for the position of the light-receiving unit of the light-emitting substrate 115*a* to overlap with the toner drop trajectory when viewed from a direction intersecting with the direction in which the toner is ejected. On the other hand, if the light-transmissive members 107 do not have such functions, it is necessary for at least part of the light-receiving unit of the light-emitting substrate 115*a* to overlap with the toner drop trajectory when viewed from a direction intersecting with the direction in which the toner is ejected.

Figure 10:
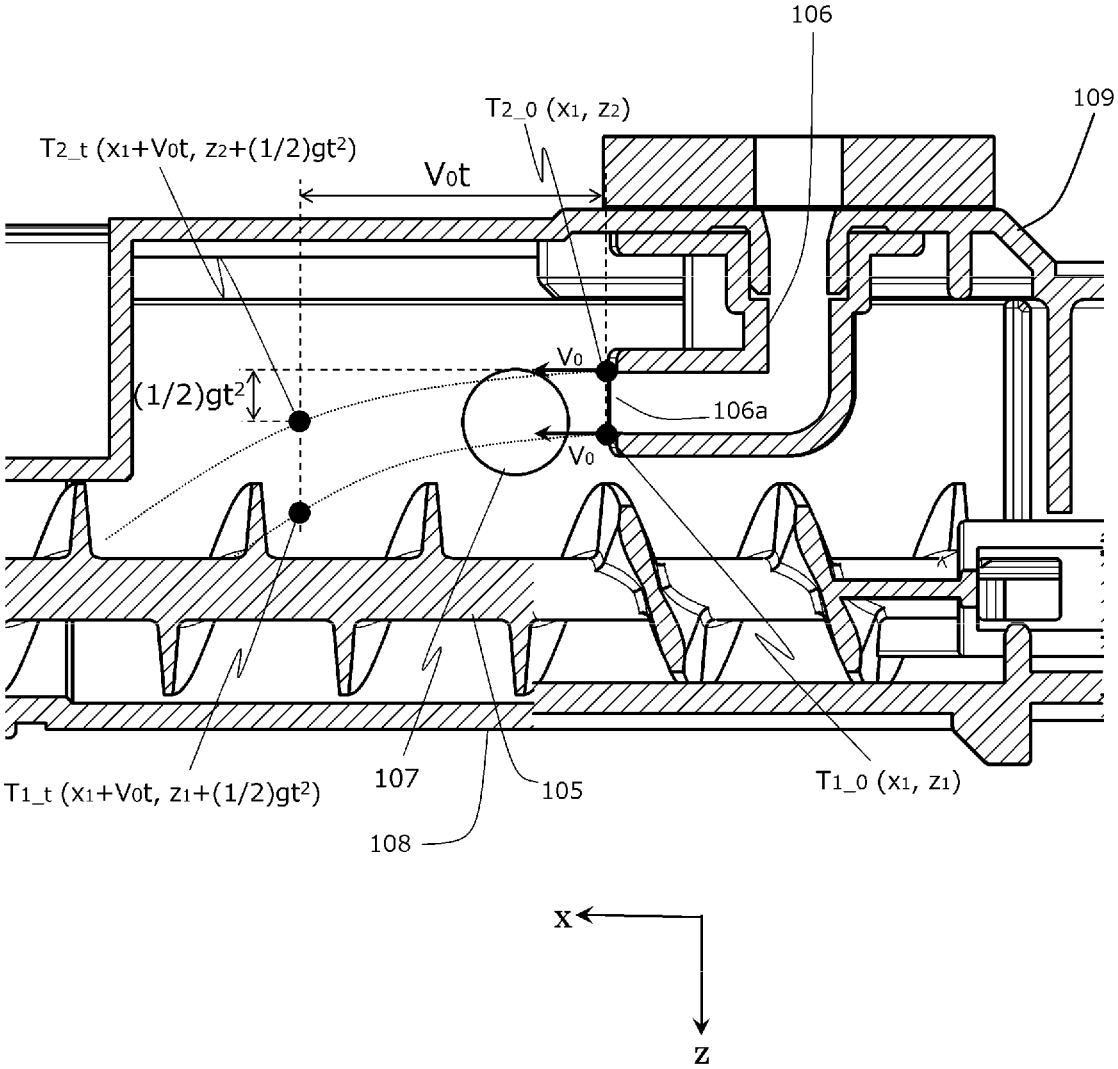
FIG. 10 is a diagram illustrating the arrangement of an optical sensor with respect to a passage area through which the output toner passes.

Conditions for determining whether or not toner is present using an optical sensor will be considered with reference to FIG. 10. Here, "no toner" means a state in which there is no toner, or almost no toner, to be discharged from the toner resupply cartridge. Or, "no toner" means a state in which the toner resupply cartridge is empty or is almost empty. FIG. 10 is a cross-sectional view illustrating part of the storage receptacle 108 in an enlarged manner, and is a diagram for considering paths (trajectories) which the discharged toner may follow while falling, along with arrangement conditions that enable the optical sensor to detect the toner while the toner is falling. As described above, by disposing the light-transmissive members 107 and the photo acceptance unit of the light-emitting substrate 115*a* so as to overlap with the passage area defined by the upper and lower ends of the toner drop trajectory K when viewed from the perspective illustrated in the drawing, the optical path intersects with the toner passage area. Note, however, that it is not absolutely necessary for the light-transmissive members 107 and the photo acceptance unit of the light-emitting substrate 115*a* to be completely within the stated passage area. As long as the light passing through the light-transmissive members 107 can be detected by the optical sensor unit 115, it is sufficient for the photo acceptance unit of the light-emitting substrate 115*a* to be disposed so as to at least partially overlap with the passage area.

The present embodiment assumes that the toner passes through the horizontal channel of the L-shaped channel 106, and is then ejected horizontally from the ejection port 106*a*. Assume that $T_1$ represents the toner ejected from the lower end of the ejection port 106*a*, $T_2$ represents the toner ejected from the upper end of the ejection port 106*a*, $T_{1_0}(x_1, z_1)$ represents coordinates of the toner $T_1$ at the time of ejection, and $T_{2_0}(x_1, z_2)$ represents coordinates of the toner $T_2$ at the time of ejection. Assume also that the direction in which the toner is ejected is the forward direction along an x-axis, and the direction in which the toner falls (downward in the vertical direction) is the forward direction along a z-axis.

Assuming the initial velocity of the toner is $V_0$ m/s, the toner moves at a constant velocity motion in the horizontal direction at a velocity Vx of $V_0$, and falls freely in the vertical direction at a velocity Vz of gt. At this time, an amount of displacement from the initial coordinates t seconds after the ejection is $(V_0t,(½)gt^2)$, and the toner drop trajectory is given as $z=(g/2V_0^2)\cdot x^2$. Therefore, the coordinates of the toner $T_1$ at t seconds after ejection are $T_{1_t}(x_1+V_0t, z_1+½\cdot gt^2)$, and the coordinates of the toner $T_2$ are $T_{2_t}(x_1+V_0t, z_2+½\cdot gt^2)$.

For the toner ejected from the ejection port 106*a*, the range of the drop trajectory is defined assuming an initial velocity of constant-velocity linear motion at $V_0$ m/s and free-fall motion. This is based on the assumption that most of the toner ejected from the ejection port 106*a* is ejected in a cluster of particles adjacent to each other, so that the effects of air resistance can be ignored.

The movement trajectory of the toner $T_1$, which has coordinates of $T_{1_0}$ $(x_1, z_1)$ at the time of ejection, can also be defined by the following formulas. The coordinates of the toner $T_1$ are expressed as follows:

$$X=x_1+V_0t \quad (1),$$

$$Z=(z_1+½\cdot gt^2) \quad (2)$$

Using formulas (1) and (2) to eliminate t provides the following formula (3).

$$Z=z_1+½\cdot g((X-x_1)/V_0)^2 \quad (3)$$

Substituting the value of X in this formula (3) as appropriate makes it possible to obtain the value of the Z-coordinate at any X-coordinate for the toner ejected from the lower end of the ejection port 106*a*. In other words, this formula (3) expresses the movement trajectory of the toner ejected from the lower end of the ejection port 106*a* in FIG. 10 as a function of the X-axis.

Likewise, the movement trajectory of the toner $T_2$, which has coordinates of $T_{2_0}$ $(x_1, z_2)$ at the time of ejection, can also be defined by the following formulas. The coordinates of the toner $T_2$ are expressed as follows:

$$X=x_1+V_0t \quad (4),$$

$$Z=(z_2+½\cdot gt^2) \quad (5)$$

Using formulas (4) and (5) to eliminate t provides the following formula (6).

$$Z=z_2+½\cdot g((X-x_1)/V_0)^2 \quad (6)$$

Substituting the value of X in this formula (6) as appropriate makes it possible to obtain the value of the Z-coordinate at any X-coordinate for the toner ejected from the upper end of the ejection port 106*a*. In other words, this formula (6) expresses the movement trajectory of the toner ejected from the upper end of the ejection port 106*a* in FIG. 10 as a function of the X-axis.

In this manner, the above formulas (3) and (6) make it possible to define the passage area (passage trajectory) of the toner ejected from the ejection port 106*a*. In the configuration according to the present embodiment, the light-transmissive members 107 are provided so that the optical path of the optical sensor overlaps with this toner passage area.

As such, the optical path P can be caused to intersect with the toner passage area by ensuring that the light-transmissive members 107 and the photo acceptance unit of the light-emitting substrate 115*a* at least partially fall within this range. Preferably, the light-transmissive members 107 are disposed so as to cover the upper and lower ends of the toner passage area, as in the example illustrated here. By doing so, any toner discharge is reliably detected by the optical sensor, which improves the accuracy of the detection.

Here, the initial velocity $V_0$ is a predetermined value determined by the characteristics of the toner, such as the material and shape, the performance of the pump 223, such as the cross-sectional area of the pump 223 and the stroke during back-and-forth movement, and the position and size of the ejection port 106*a*. In other words, the first trajectory and the second trajectory described above are also determined by the characteristics of the toner, such as the material and shape, the performance of the pump 223, such as the cross-sectional area of the pump 223 and the stroke during back-and-forth movement, and the position and size of the ejection port 106*a*. As such, the area through which the toner passes after ejection can be calculated in advance using the above formulas. Therefore, disposing the light-transmissive members 107 so as to overlap with the toner passage area when the light-transmissive members 107 are projected makes it possible to reliably detect whether or not there is any toner remaining.

The shape of the channel through which the toner output from the pump is ejected into the storage receptacle 108 is not limited to being L-shaped. Furthermore, the method for ejecting the toner is not limited to horizontal ejection. For example, the toner can be allowed to fall freely, or can be ejected at an angle. Even in such a case, the light-transmissive members 107 and the optical sensor may be disposed in accordance with the trajectory which the toner is expected to follow while falling.

As described thus far, according to the present invention, the light transmitting members are provided in the vicinity of a path through which the toner passes, and thus the discharged toner can be detected directly. This makes it possible to quickly determine that the toner in the toner resupply cartridge has run out or is close to running out, which in turn makes it possible to improve usability.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-207173, filed on Nov. 15, 2019, which is hereby incorporated by reference herein in its entirety.

What is claimed is:

1. A toner transport apparatus for transporting toner toward a developing apparatus, the toner transport apparatus comprising:

a toner container configured to store toner;

a transport container configured to receive the toner from the toner container and having a transport path for transporting the toner toward the developing apparatus;

a pipe through which the toner is transported from the toner container to the transport container, the pipe having an outlet hole from which the toner is discharged into the transport container;

an air pump configured to transport, by air generated by expansion and contraction of the air pump, the toner from the toner container to the transport container through the pipe; and an optical sensor including a light-emitting element configured to emit a light and a light-receiving element configured to receive the light that is provided so that an optical path from the light-emitting element to the light-receiving element intersects with a passage area of the toner through which the toner passes after being discharged from the outlet hole of the pipe and before landing at a landing point of the transport container.

2. The toner transport apparatus according to claim 1, wherein first and second transmissive portions are provided in a wall of the transport container so as to face each other in a direction intersecting with a direction in which the pipe extends, wherein the light-emitting element is disposed to face the first light-transmissive portion and the light-receiving element is disposed to face the second light-transmissive; portion, and wherein light traveling from the light-emitting element to the light-receiving element passes through the first light-transmissive portion, the passage area, and the second light-transmissive portion in this order.

3. The toner transport apparatus according to claim 1, wherein the pipe includes a horizontal portion that extends in a substantially horizontal direction and has the outlet hole in a downstream and thereof in a toner transporting direction.

4. The toner transport apparatus according to claim 3, wherein the toner container is disposed above the transport container unit; and wherein the pipe further includes a vertical portion that extends in a substantially downward vertical direction, has an entrance hole in an upstream end thereof in the toner transporting direction, and is connected to the horizontal portion, with the toner received from the toner container entering into the pipe through the entrance hole of the vertical portion and being discharged from the pipe through the outlet hole of the horizontal portion.

5. The toner transport apparatus according to claim 1, wherein the transport container includes an upstream-side transport portion that transports the toner in a horizontal direction, and a downstream-side transport portion that is connected to the upstream-side transport portion and that transports the toner upward in a vertical direction, wherein the optical sensor unit is disposed in the upstream-side transport portion.

6. An image forming apparatus comprising:

a developing apparatus including a developing roller configured to bear the toner; and the toner transport apparatus according to claim 5, wherein the developing apparatus is disposed above the toner container, and wherein the toner is transported from the toner container to the developing apparatus through the upstream-side transport portion and the downstream-side transport portion of the toner transport apparatus.

7. The toner transport apparatus according to claim 1, further comprising: a screw configured to transport the toner in a toner transporting direction of the screw and provided inside the transport container, wherein the pipe is disposed above the screw.

8. The toner transport apparatus according to claim 7, wherein the pipe extends in the toner transporting direction of the screw, and wherein the outlet hole of the pipe opens toward a downstream side in the toner transporting direction of the screw.

9. The toner transport apparatus according to claim 8, wherein the optical path is overlapped with the outlet hole of the pipe when viewed in the toner transporting direction of the screw.

10. The toner transport apparatus according to claim 7, wherein the outlet hole of the pipe is disposed between a downstream end of the screw and the upstream end of the screw in the toner transporting direction.

11. The toner transport apparatus according to claim 8, wherein the outlet hole of the pipe is disposed between a downstream end of the screw and the upstream end of the screw in the toner transporting direction.

12. The toner transport apparatus according to claim 1, wherein the pipe is attached to the transport container, and wherein the toner container is detachably attached to the transport container.

13. The toner transport apparatus according to claim 12, wherein the air pump is attached to the toner container.

* * * * *